US006402540B1

(12) United States Patent
Kuhmel et al.

(10) Patent No.: US 6,402,540 B1
(45) Date of Patent: Jun. 11, 2002

(54) SCOOP-PROOF PLUG CONNECTOR SYSTEM

(75) Inventors: Bernhard Kuhmel, Altdorf; Frank Odorfer, Nuremberg, both of (DE)

(73) Assignee: Framatome Connectors Internationals, Courbevoie (FR)

( * ) Notice: Subject to any disclaimer, the term of this patent is extended or adjusted under 35 U.S.C. 154(b) by 0 days.

(21) Appl. No.: 09/639,694

(22) Filed: Aug. 16, 2000

(30) Foreign Application Priority Data

Aug. 20, 1999 (DE) ..... 199 39 407

(51) Int. Cl.[7] ..... H01R 13/64
(52) U.S. Cl. ..... 439/378; 439/352; 439/357
(58) Field of Search ..... 439/374, 188, 439/189, 350, 352, 353, 357, 355, 358, 378

(56) References Cited

U.S. PATENT DOCUMENTS 5,275,575 A * 1/1994 Cahaly et al. ..... 439/188
5,924,885 A 7/1999 Pacher ..... 439/352

FOREIGN PATENT DOCUMENTS

| | | |
|---|---|---|
| DE | 19704991 A1 | 8/1997 |
| EP | 0828321 A2 | 3/1998 |
| WO | WO 97/41623 | 11/1997 |

* cited by examiner

*Primary Examiner*—Gary Paumen
*Assistant Examiner*—Alexander Gilman
(74) *Attorney, Agent, or Firm*—Perman & Green, LLP

(57) ABSTRACT

The invention specifies a scoop-proof plug connector system having a connector (1) which has a pair of contact sockets (66, 67) situated in the plug-in projection (3) and a connector housing (2), a mating connector for an igniter, which has a pair of contact pins (51, 52) situated in one plane for insertion into the contact sockets (66, 67), and a coupling piece **(30*a*, 30*b*) which is situated in the mating connector and has a recess (34), which is complementary to the plug-in projection (3) and an essentially cylindrical sleeve (31). At least one guide shoulder (35, 36; 43, 44) which runs parallel to the insertion direction and essentially over the full height of the sleeve (31) and which projects above the contact pins (51, 52) is integrally formed in the recess (34)**.

9 Claims, 5 Drawing Sheets

SCOOP-PROOF PLUG CONNECTOR SYSTEM

Figure 1:
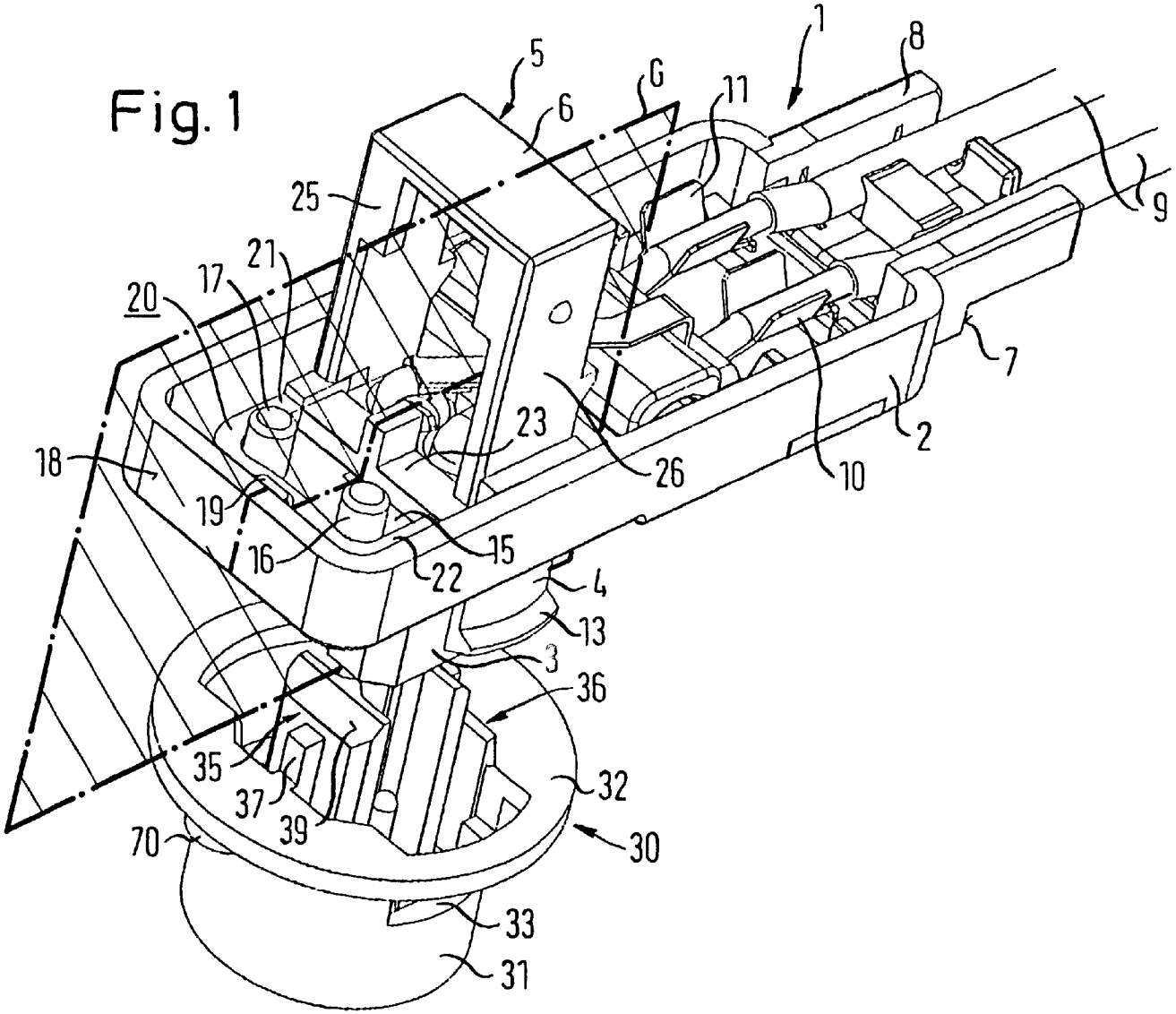

The present invention relates to a scoop-proof plug connector system.

Such plug connector systems are used in automobile technology, for example, in order to produce an electrical connection on which high demands are to be made. On the one hand, this concerns the reliability with which such a connection needs to be made, and, on the other hand, it relates to protecting against incorrect handling of the plug connector system.

The document WO 97/41623 discloses a plug connector having a secondary locking mechanism and the outgoing cable at the side, said plug connector being inserted into a coupling piece which has a shorting bridge and is situated in an igniter receptacle having contact pins. To effect secondary locking of the plug connector in the coupling piece, a clip is pushed in along the latching arms on the plug connector, with the result that they cannot escape from their holders made in the igniter receptacle.

When such plug connectors are assembled, it is quite possible for the plug-in projection to be incorrectly oriented with respect to the coupling piece. A disadvantage of this is that, despite being incorrectly oriented, this plug-in projection can reach the contact pins on the igniter receptacle, can touch them, possibly bend them and can even break them off. To actuate the secondary locking mechanism, it is necessary to move either a blocking slide or even the secondary locking mechanism itself such that the latter can be pressed down into the plug connector. A disadvantage of this is that the fitter can release and even press down the secondary locking mechanism without the plug connector needing to be in the coupling piece or in the macing connector.

The object of the invention is to present a plug connector system which protects the contact pins on an igniter the connector being plugged on incorrectly.

The scoop-proof plug connector according to the invention comprises a connector which has a pair of contact sockets situated in the plug-in projection and a connector housing, a mating connector for an igniter which has a pair of contact pins situated in one plane for insertion into the contact sockets and a holder, and an essentially cylindrical coupling piece which is situated in the mating connector, has a recess, which is complementary to the plug-in projection, and whose sleeve is shaped so as to be complementary to the holder. In addition, at least one guide shoulder which runs parallel to the insertion direction and essentially over the full height of the sleeve and which projects above the contact pins is integrally formed in the recess.

The invention affords the advantage that, when the plug connector system is assembled, the contact pins on the igniter can no longer be damaged by the plug-in projection on the connector.

One advantageous refinement of the invention is that, when the connector is inserted into the mating connector, a free end of a guide shoulder passes into an opening in the connector and acts against an elastic element, with the result that the secondary locking mechanism can be transferred from a released position into a locked position. This particular design affords the advantage that the secondary locking mechanism can be pushed into the connector only if said connector is located in the mating connector or in the coupling piece. In addition, apart from the insertion operation, no additional action by the fitter is necessary in order to release the secondary locking mechanism, This effectively prevents incorrect operation of the secondary locking mechanism.

The independent claims specify further preferred embodiments of the invention.

Figure 2B:
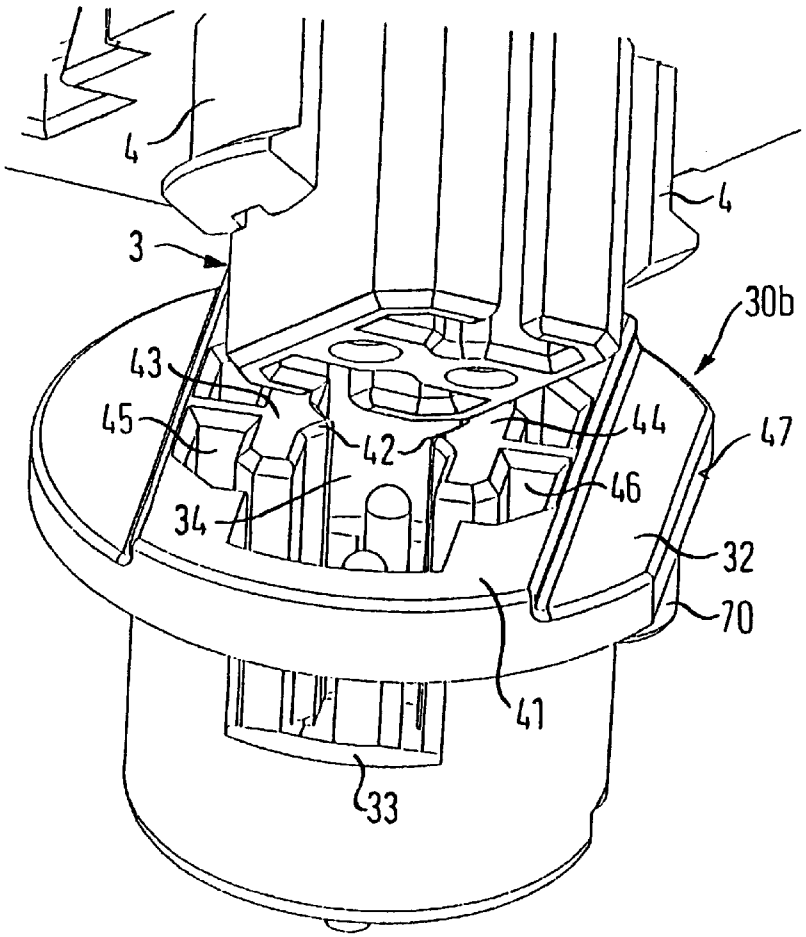
Figure 2A:
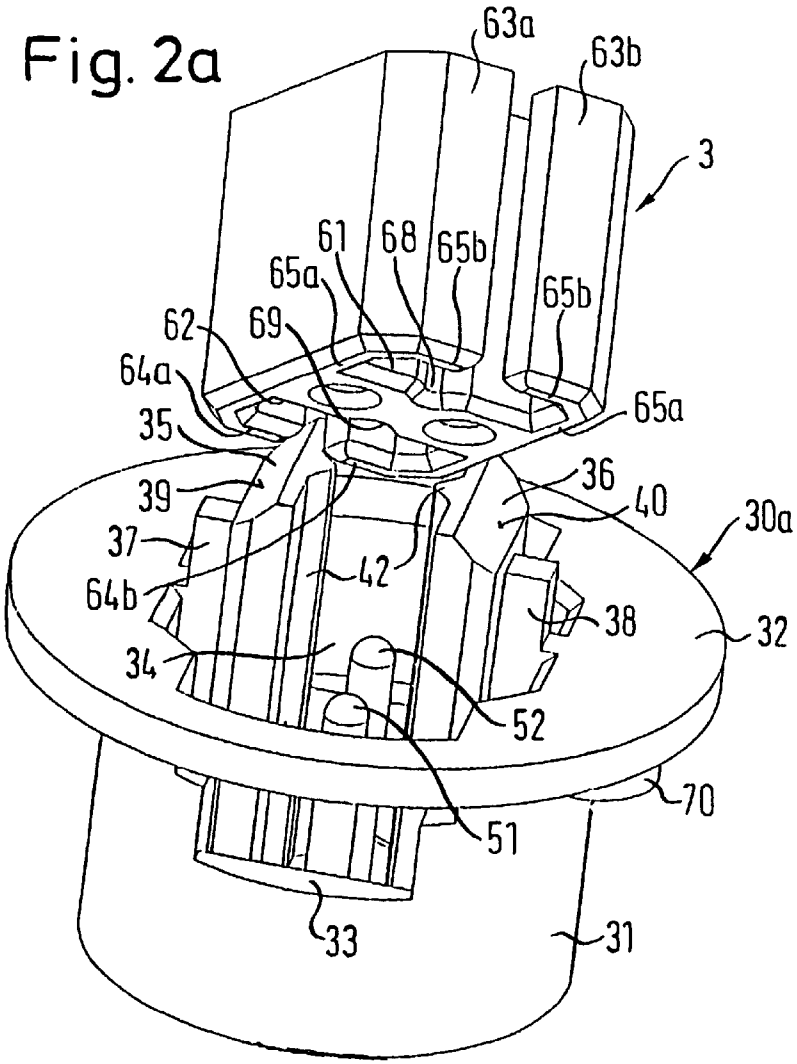
Figure 3B:
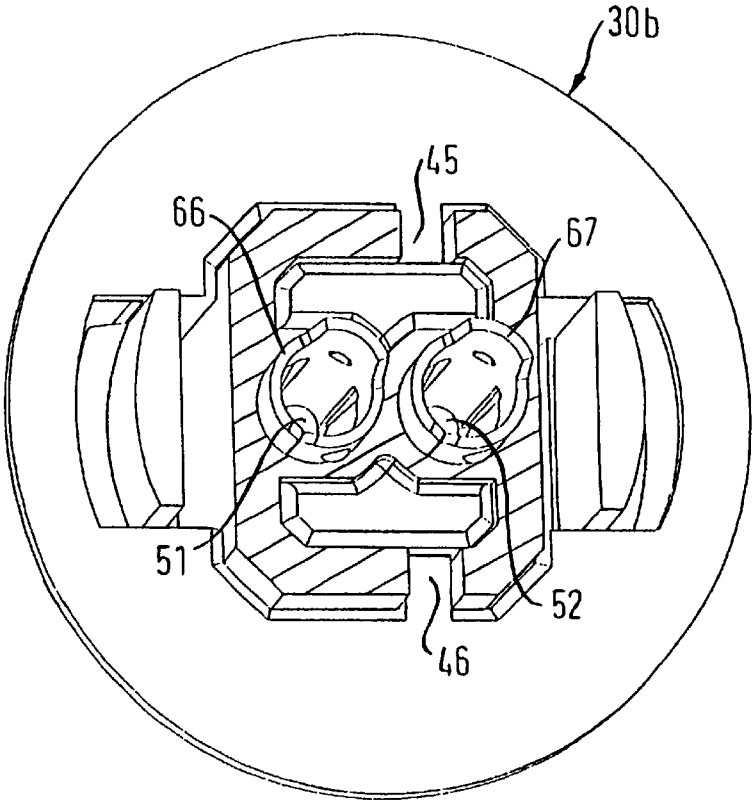
Figure 3A:
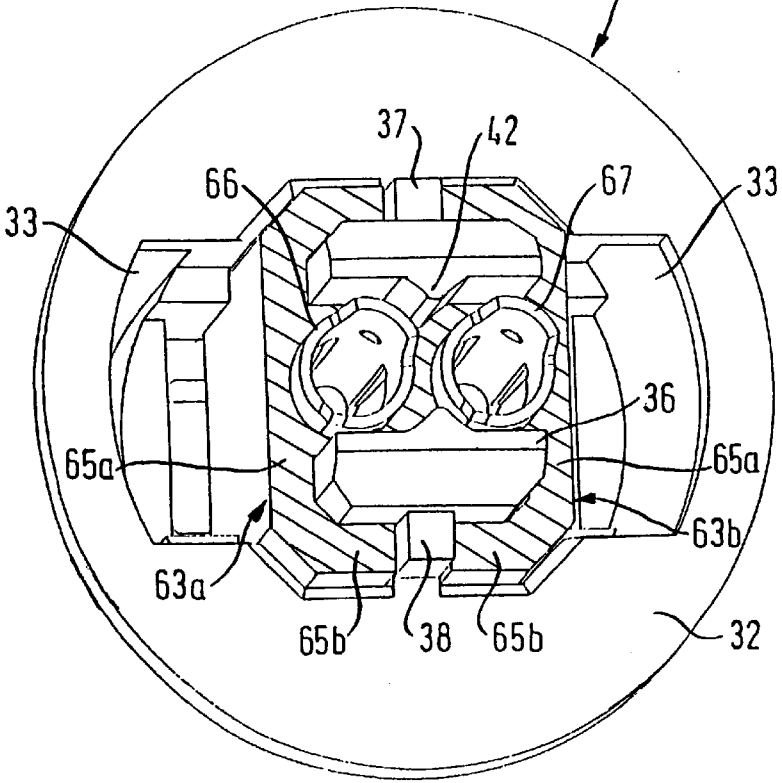
Figure 4A:
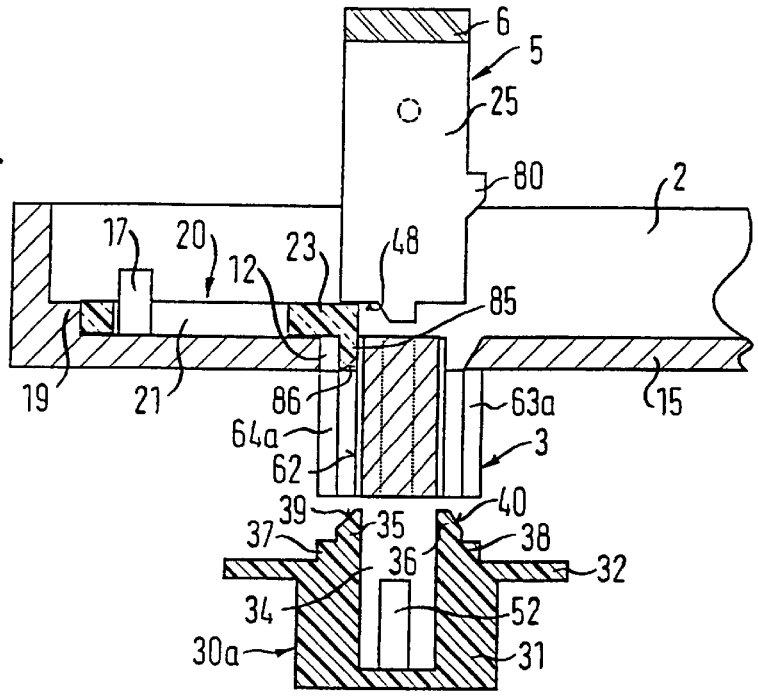
Figure 4B:
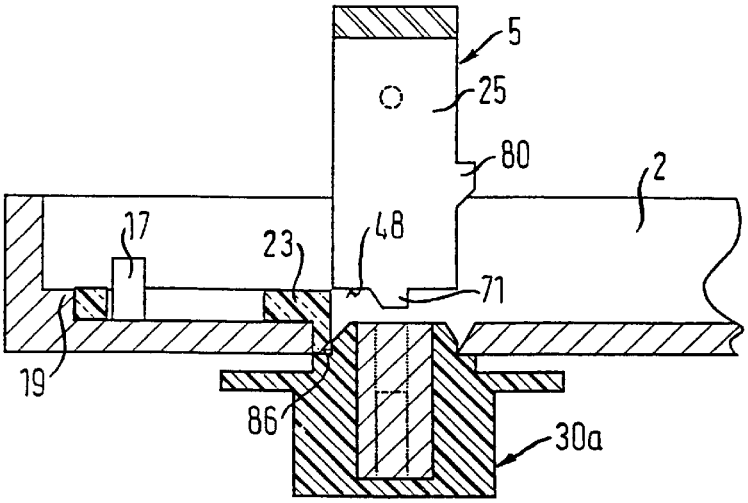
Figure 4C:
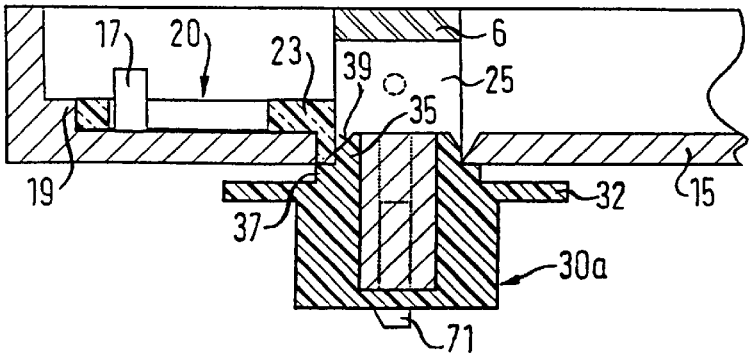
Figure 5A:
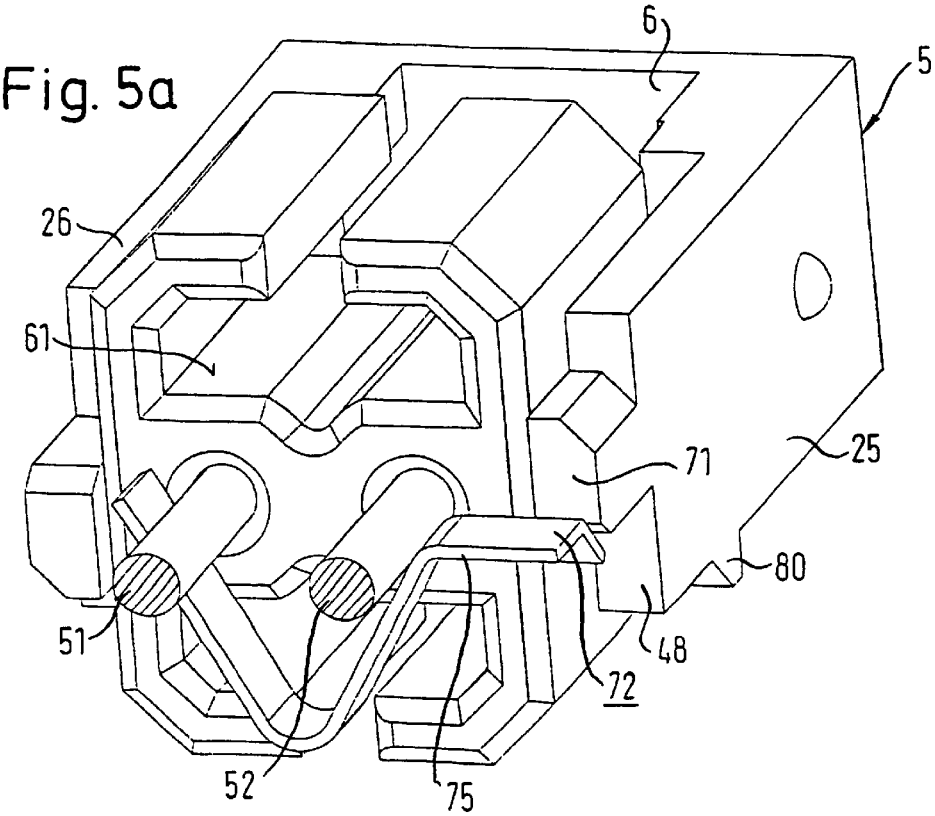

Preferred illustrative embodiments of the plug connector according to the invention are described in detail below with reference to the drawing, in which:

FIG. 1 shows an angled view of a connector according to the invention and of a coupling piece according to the invention;

FIGS. 2*a*, 2*b* show two different embodiments of a coupling piece according to the invention with guide shoulders of different lengths;

FIGS. 3*a*, 3*b* show a plan view of the coupling pieces from FIGS. 2*a* and 2*b* with a plug-in projection inserted, said plug-in projection being in transverse section with respect to the insertion direction;

FIGS. 4*a*, 4*b* and 4*c* show a section along the plane G, with the various insertion phases being shown: and FIGS. 5*ab*, 5*b* show an angled view of the plug-in projection's connector face with the secondary locking mechanism pushed in partially and fully, respectively.

The top part of FIG. 1 shows an angled view of a connector 1 having a housing 2, a plug-in projection 3 integrally formed thereon at right angles, and two tongues 4 which are likewise integrally formed at right angles to the housing 2. Integrally formed on the back 7 of the housing 2 is a cable exit a having two cables 9 crimped onto contact elements 10 and 11. These contact elements 10 and 11 run essentially longitudinally in the housing 2 and merge into contact sockets in the connector which have been fully accommodated in the plug-in projection 3 in appropriate compartments. Integrally formed on the bottom 15 of the housing 2 and in the housing 2 close to the front 18 of the connector 1 are two pins 16 and 17 for fixing a U-shaped elastic element 20. In addition the front is of the housing 2 has, essentially in the centre, a shoulder 19 projecting into the interior of the housing. Furthermore, the connector 1 comprises a U-shaped elastic element 20 having a base, which is situated between the pins 17 and 16 and the shoulder 19 and has two limbs 21 and 22 which are integrally formed at right angles to it and are connected to one another by a cross brace 23. Above the open housing 2 and partially inserted therein is a secondary locking mechanism 5 having a base 6 and two arms 25 and 26 which are integrally formed at right angles to said base and are obstructed by the cross brace 23.

The bottom part of FIG. 1 shows an essentially cylindrical coupling piece 30 according to the invention.

The coupling piece 30 will be explained more precisely with the aid of FIG. 2*a*, which shows an angled view of the coupling piece from FIG. 1 with a plug-in projection 3 positioned at an angle. The coupling piece 30 has a cylindrical sleeve 31 with a collar 32 formed outwards on the front of said coupling piece. The sleeve contains a through opening 34 running from the front to the back (running in the plugging direction) to hold the plug-in projection 3. Integrally formed on the edge of the opening 34 are two guide shoulders 35 and 36 which are opposite the opening 34 and run at least over the full height of the coupling piece in the insertion direction, as can be seen in FIG. 2*b*. In the embodiment in FIG. 2*a*, the guide shoulders project beyond the collar 32. A common feature of the two embodiments of the coupling piece 30 is that the guide shoulders 35 and 36 are connected to the sleeve 31 by means of a coding rib 37 and 38. Two cutouts 33 for holding the latching tongue 4 on the plug-in projection 3 are arranged diametrically opposite in the sleeve 31 at right angles to the guide ribs 35 and 36. As already mentioned, the guide ribs 35 and 36 in the first embodiment, shown in FIG. 2*a*, project above the collar 32, with the outwardly pointing edges 39 and 40 of the two guide shoulders 35 and 36 being bevelled. Likewise, the coding ribs 37 and 38 project above the collar 32, but these end below the bevelled edges 39 and 40.

In contrast to this, the second embodiment, shown in FIG. 2*b*, has a slight elevation 41 with respect to the collar 32. Both the guide shoulders 43 and 44 and the coding ribs 45 and 46 in the second embodiment, shown in FIG. 2*b*, end flush with the elevation 41. (Both embodiments have, on each guide shoulder 35, 36, 43, 44, a guide lug 42 which runs over the full height and in the plugging direction and projects inwards essentially in the centre of the guide shoulder.) Beneath the collar 32, semicircular coding lobes 70 can be seen. The collar 32 in the second embodiment, shown in FIG. 2*b*, is cut oft essentially parallel to the insertion direction, so that an edge 47 is produced. The contact pins 51 and 52 project into the opening 34, these contact pins being situated in the insertion direction and in a plane which is parallel to the extension of the guide shoulders.

On each of its two opposite side faces 61 and 62, the essentially rectangular plug-in projection 3 has two essentially L-shaped arms 63*a*, 63*b*, 64*a* and 64*b*, and one limb 65*a* of each of the two arms is integrally formed on the side face 61 at right angles such that the other two limbs 65*b* point towards one another, so that the arms 63*a* and 63*b* engage around the guide shoulder 36, for example, when the connector 1 is inserted into the coupling piece 30. As FIGS. 3*a* and 3*b* clearly show, when the connector is inserted, the limbs 65*b* of the two arms 63*a* and 63*b* are situated between the guide shoulder 36 and the inner wall of the sleeve 31. The same also applies to the L-shaped arms 64*a* and 64*b*. The rectangular plug-in projection has two plug-in compartments running in the plugging direction for holding contact sockets 66 and 67. In addition, a respective groove 68 and 69 for holding the guide lugs 42 is made essentially in the centre of the side faces 61 and 62 over the full length of the plug-in projection 3. These grooves 68 and 69 divide the plug-in projection 3 into halves of essentially the same size, each half containing precisely one of these contact sockets 66 and 67.

FIGS. 3*a* and 3*b* show a plan view of the coupling piece 30*a* and 30*b* with a plug-in projection 3 inserted which is cut open at the level of the collar 32, so that the contact sockets 66 and 67 project out of the plug-in projection. In these contact sockets, the contact pins 51 and 52 on the igniter can be seen. When the connector has been inserted, as shown here, the latching arms 4 enter the cutouts 33.

FIGS. 4*a* to 4*c* show a section along the plane G in FIG. 1, this section likewise passing through the coupling piece 30. The section plane passes through the two opposite coding ribs 37 and 38. These FIGS. 4*a* to 4*c* will be used to explain an illustrative embodiment of the coupling piece 30*a*. The top half of FIG. 4*a* shows the housing 2 of the connector 1. Projecting from this housing 2 is the partially inserted secondary locking mechanism 5. It should be noted that FIG. 4*a* reproduces the state in FIG. 1. As already mentioned, the bottom 15 in the housing 2 holds the elastic element 20 with wings 21 and a cross brace 23, said cross brace hating a finger 85 which is integrally formed at right angles, has a bevelled end 86 and projects into a window 12 made in the bottom 15. As can be seen in FIG. 4*a*, the finger 85 rests against the side wall 62. The top edge of the cross brace 23 runs below the front edge 48 of the limb 25. This means that it is not possible to press the secondary locking mechanism 5 further into the housing 2. When the connector 1 is inserted into the coupling piece 30*a*, see FIG. 4*b*, the plug-in projection 3 enters the opening 34, the guide lugs 42 enter the grooves 68 and 69, and the arms 63 and 64 engage accordingly around the guide shoulders 35 and 36. The contact pins 51 and 52 enter their corresponding contact sleeves 66 and 67. During this insertion operation, the guide shoulder 35 passes into the window 12, for example, so that the angled edge 39 reaches the bevelled end of the cross brace 23 and pushes it to the left, with the result that the finger 85 hits the bottom 15. The top edge of the cross brace 23 then releases the front edge 48. It is now possible to press the secondary locking mechanism 5 downwards, as can be seen in FIG. 4*c*, so that the limbs pass between the plug-in projection 3 and the tongues 4 to prevent the latter from springing back. At the same time, the latching hook 80 integrally formed on the side of the limb 25 arrives underneath the bottom 15 and locks the secondary locking mechanism in a locked position. When the secondary locking mechanism and the coupling piece 30*a* are pulled out, the spring force of the elastic element 20 pushes the cross brace 23 underneath the front edge 4*e* of the secondary locking mechanism again, so that said secondary locking mechanism is protected against being unintentionally pressed downwards. There is nothing to stop it being used again.

Figure 5B:
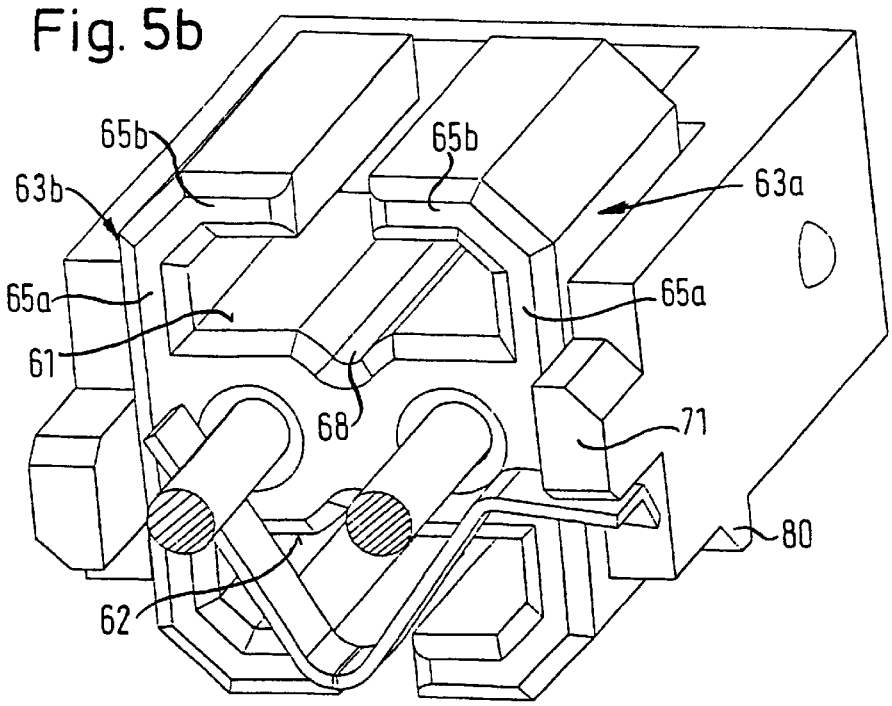

As FIGS. 5*a* and 5*b* show, the protrusion 71 integrally formed on the front edge 58 can additionally release an essentially V-shaped shorting bridge 72 during the insertion operation. The shorting bridge 72 protects the ignition capsule against unintentional triggering, but it is necessary to ensure that it is raised from at least one contact pin 51 or 52 when the connector is inserted, so that the control electronics can ignite the primer as necessary. During the insertion operation or during locking, the limbs 25 and 26 on the clip-like secondary locking mechanism engage around the plug-in projection 3. (FIGS. 5*a* and 5*b* show the contact pins 51 and 52, inserted into the compartments in the plug-in projection 3, and the shorting bridge 72 in angled plan views of the plug-in projections connector face. In addition, the clip-like secondary locking mechanism 5 engaging around the plug-in projection can be seen. FIG. 5*a* shows that the shorting bridge touches both contact pins; in contrast to this, the shorting bridge in FIG. 5*b* is raised from one contact pin. An outwardly pointing clip 75 on the shorting bridge 72, which clip projects over the plug-in projection and runs transversely with respect to the insertion direction, is raised by the protrusion 71 during insertion, so that this very bridge is opened.)

What is claimed is:

1. Scoop-proof plug connector system comprising:

a connector which has a pair of contact sockets situated in the plug-in projection and a connector housing, a mating connector, which has a pair of contact pins situated in one plane for insertion into the contact sockets, and a coupling piece which is situated in the mating connector and has a recess, which is complementary to the plug-in projection, and an essentially cylindrical sleeve, wherein at least one guide shoulder which runs parallel to an insertion direction and essentially over the full height of the sleeve and which projects above the contact pins is integrally formed in the recess and wherein the plug-in projection has at least one arm which runs parallel to the insertion direction and engages around the guide shoulder from the side thereof when the connector is inserted into the coupling piece.

2. Scoop-proof plug connector system according to claim 1, wherein at least one guide shoulder is part of a first coding profile, which is complementary to a second coding profile on the plug-in projection.

3. Scoop-proof plug connector system according to claim 1, wherein the front of the coupling piece, which faces the connector, has a circular outwardly pointing collar having two openings for tongues to latch into, said tongues comprising latching lugs, running parallel to the plug-in projection and being integrally formed on the connector housing.

4. Scoop-proof plug connector system according to claim 1, wherein the connector has a secondary locking mechanism which can be moved from a released position into a locked position, so that the arms of the secondary locking mechanism are engaged with the tongues on the connector, the secondary locking mechanism being fixed in is released position by an elastic element.

5. Scoop-proof plug connector system according to claim 4 wherein, the coupling piece has an elastic shorting bridge for electrically connecting the two contact pins at least one protrusion integrally formed on the front edge of a limb being able to raise the shorting bridge from at least one contact pin when the clip is in the secured position.

6. Scoop-proof plug connector system comprising:

a connector which has a pair of contact sockets situated in the plug-in projection and a connector housing, a mating connector for an igniter, which has a pair of contact pins situated in one plane for insertion into the contact sockets, a coupling piece which is situated in the mating connector and has a recess, which is complementary to the plug-in projection, and an essentially cylindrical sleeve, at least one guide shoulder which runs parallel to an insertion direction and essentially over the full height of the sleeve and which projects above the contact pins is integrally formed in the recess and wherein the outwardly pointing edges of the guide shoulder are beveled and the coding ribs end below the guide shoulder, the guide shoulder and the coding ribs projecting above the collar, which is arranged at right angles thereto, so that at least one edge of the guide shoulder projects into the housing bottom of the connector housing when the connector is inserted into the coupling piece.

7. Scoop-proof plug connector system comprising:

a connector which has a pair of contact sockets situated in the plug-in projection and a connector housing, a mating connector for an igniter, which has a pair of contact pins situated in one plane for insertion into the contact sockets, a coupling piece which is situated in the mating connector and has a recess, which is complementary to the plug-in projection, and an essentially cylindrical sleeve, at least one guide shoulder which runs parallel to an insertion direction and essentially over the full height of the sleeve and which projects above the contact pins is integrally formed in the recess and wherein, when the connector is inserted into the mating connector, one edge of a guide shoulder passes into a window in the connector and acts against an elastic element, so that the secondary locking mechanism can be transferred from a released position into a locked position.

8. Scoop-proof plug connector system according to claim 7, wherein the clip has two arms which can be inserted between the plug-in projection and the tongues, are connected to one another by means of a transversely running base and each comprise a latching hook which is integrally formed transversely with respect to the insertion direction and engages below the housing bottom in the secured position.

9. Scoop-proof plug connector system comprising:

a connector which has a pair of contact sockets situated in the plug-in projection and a connector housing, a mating connector for an igniter, which has a pair of contact pins situated in one plane for insertion into the contact sockets, a coupling piece which is situated in the mating connector and has a recess, which is complementary to the plug-in projection, and an essentially cylindrical sleeve, at least one guide shoulder which runs parallel to an insertion direction and essentially over the full height of the sleeve and which projects above the contact pins is integrally formed in the recess and wherein the connector has a secondary locking mechanism which can be moved from a released position into a locked position, so that arms of the secondary locking mechanism are engaged with the tongues on the connector, the secondary locking mechanism being fixed in its released position by an elastic element and wherein the elastic element has a cross brace which can be moved on the housing bottom and underneath at least one of the front edges and has a finger which runs parallel to the insertion direction and projects into a window made in the housing bottom, the beveled edge pressing against the beveled end of the finger when the connector is inserted into the coupling piece, with the result that the cross brace releases the clip so that it can be pressed downwards.

* * * * *